US005778473A

United States Patent [19]

Chen

[11] Patent Number: 5,778,473

[45] Date of Patent: Jul. 14, 1998

[54] METHOD OF FORMING A BOOT

[75] Inventor: Eddie Chen, Taichung, Taiwan

[73] Assignee: C Two Corporation, Taichung, Taiwan

[21] Appl. No.: 795,676

[22] Filed: Feb. 6, 1997

[51] Int. Cl.[6] ..... A43B 1/10

[52] U.S. Cl. ..... 12/142 T; 12/142 E; 36/4

[58] Field of Search ..... 12/142 E, 142 EV, 12/142 RS, 142 T; 36/4, 14

[56] References Cited

U.S. PATENT DOCUMENTS

| | | | |
|---|---|---|---|
| 997,064 | 8/1911 | Savage | 36/4 |
| 1,725,749 | 8/1929 | Blair | 36/4 |
| 4,170,802 | 10/1979 | Roy | 12/142 RS |
| 4,930,175 | 6/1990 | Chen | 12/142 E X |
| 5,189,814 | 3/1993 | Barma | 36/4 |

FOREIGN PATENT DOCUMENTS

| | | | |
|---|---|---|---|
| 2526668 | 11/1983 | France | 36/4 |

*Primary Examiner*—Ted Kavanaugh
*Attorney, Agent, or Firm*—Fish & Richardson P.C.

[57] ABSTRACT

A method of making a boot having an upper, a lower and a sole is disclosed. The method includes the step of connecting the lower to the sole in a water-tight relationship only after the lower is connected to the upper.

6 Claims, 6 Drawing Sheets

METHOD OF FORMING A BOOT

BACKGROUND OF THE INVENTION

1. Field of the Invention The invention relates to a boot, more particularly to a method of forming a boot having an upper, a lower and an outsole.

2. Description of the Related Art

As illustrated in FIG. 1, the conventional method of forming a boot comprises the steps of:

(a) molding the outsole 4 integrally with the lower 3 so as to form a unitary construction from a waterproof polymeric thermosetting material;

(b) forming an upper 1 from a relatively flexible material, the upper having a lower peripheral edge stitched to an upper peripheral edge of the lower 3 to form a seam juncture 5; and (c) coating the inner surface of the seam juncture with a waterproof layer.

Because the seam juncture 5 is spaced from the top of the boot at a considerable vertical distance, it is relatively difficult to insert the tool for coating the waterproof layer on the seam juncture through the upper portion of the boot.

In addition, because the lower 3 is made from the same material as that of the outsole 4, which in turn is generally made from hard and abrasive resistant rubber to be able to withstand wearing, the boot is relatively heavy, thereby easily causing fatigue to the wearer.

SUMMARY OF THE INVENTION

Therefore, an object of this invention is to provide a method of making a boot, wherein the sole of the boot is connected to the lower after the lower is connected to the upper so that a waterproof layer can be provided at the seam between the upper and the lower conveniently through the uncovered lower opening of the lower.

Still another object of this invention is to provide a method of making a boot whose lower is made of a material of lighter weight than that of the outsole so that the boot is relatively light in weight and is more comfortable to wear as compared to the boot produced according to the conventional method.

Accordingly, the method of making a boot in the present invention comprises the steps of:

(a) forming a lower of unitary construction from a first waterproof polymeric material, the lower defining an enclosed toe zone and a heel zone and having a first upper end portion defining a first upper opening, and a first lower end portion defining a sole opening;

(b) forming an upper from a relatively flexible material, the upper having a second lower end portion of a size such that the first upper end portion can be smoothly seamed to the second lower end portion;

(c) joining the second lower end portion with the first upper end portion of said lower to form a seam juncture;

(d) applying a waterproof layer onto the seam juncture through the sole opening; and (e) connecting a sole to the first lower end portion of the lower in a water-tight relationship so as to close the sole opening after step (d).

A water-tight seal may be formed by providing a waterproof layer at the adjoining surfaces of the lower and the sole or by injection molding the sole in the presence of the lower to form the sole integrally with the lower.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
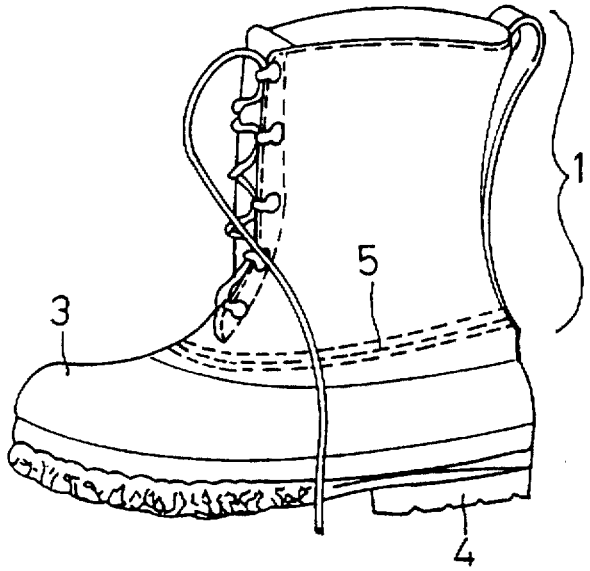
FIG. 1 is a perspective and schematic view of a boot produced according to a conventional method.
Figure 2:
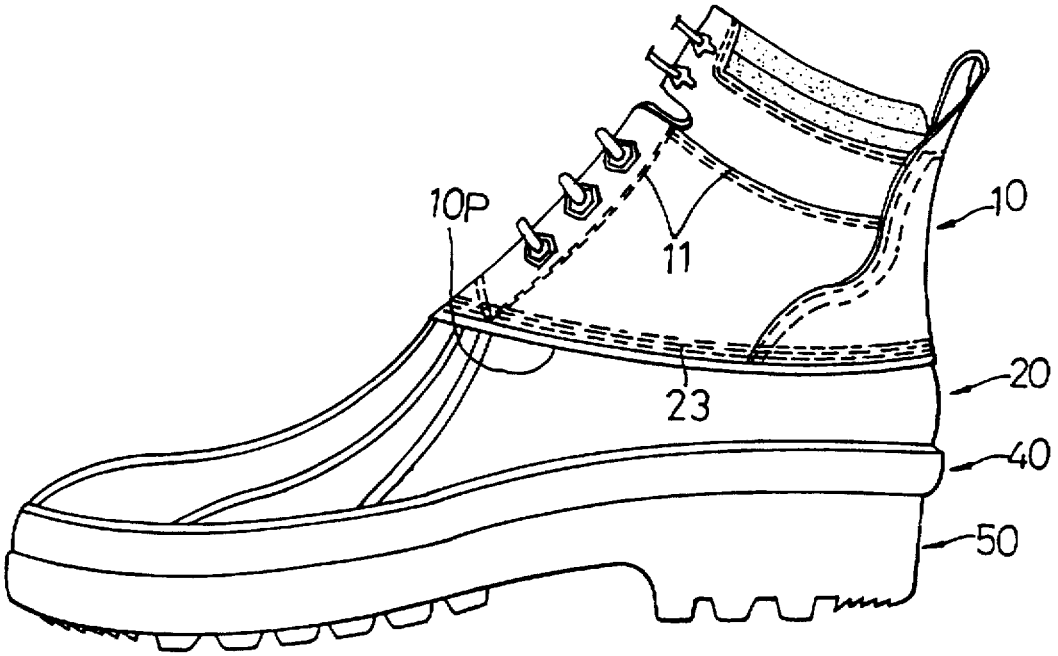
FIG. 2 is a perspective and schematic view of a boot which is produced according to the method of this invention.
Figure 3:
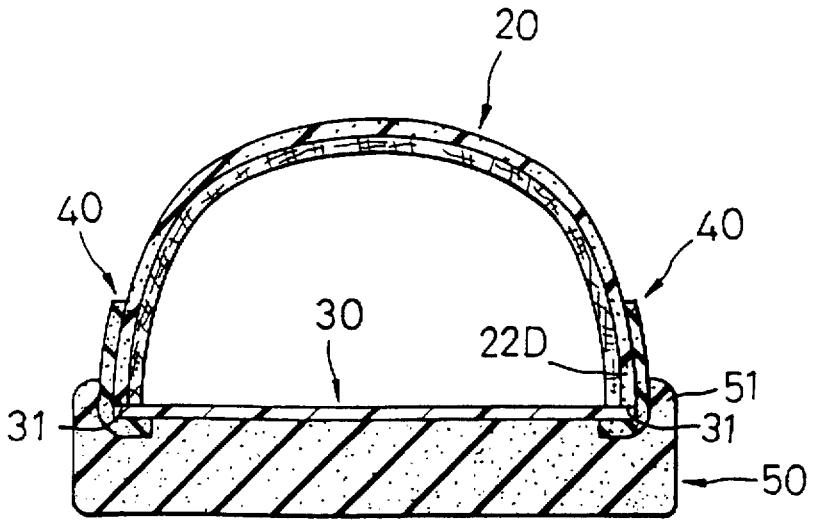
FIG. 3 is a sectional view of the boot produced according to the method of this invention.
Figure 4:
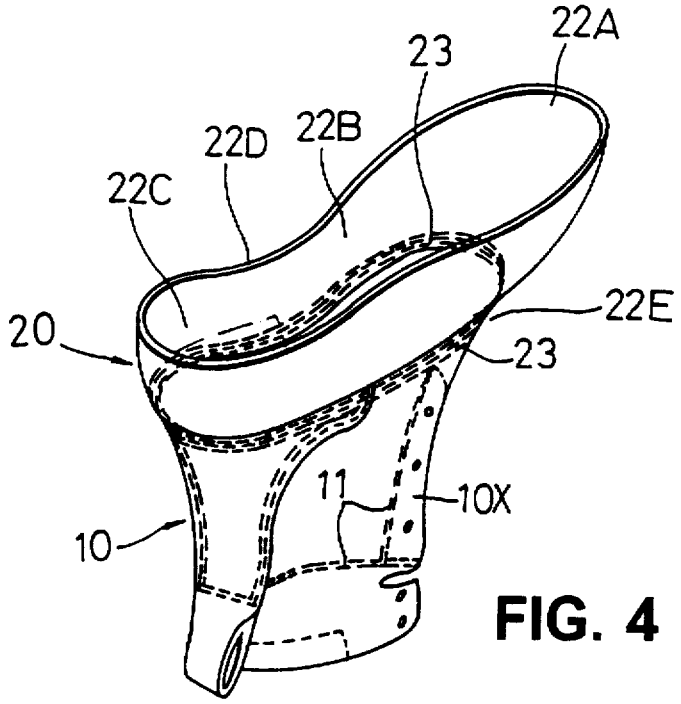
FIG. 4 is an inverted view of the boot produced according to this invention, illustrated prior to attachment of an outsole.

Referring to FIGS. 2, 3 and 4, the preferred embodiment of a boot according to this invention includes a horizontally extending outsole 50, a shell-like lower 20 disposed on the outsole 50, and an upper 10 connected to an upper section of the lower 20 so as to form the boot.

According to this invention, the method of making a boot includes the following steps:

Step (a): A lower of unitary construction is molded from a first waterproof polymeric material, such as PU elastomer (polyurethane) or PVC elastomer (polyvinyl chloride) or rubber. The lower 20 defines an enclosed toe zone 22A, a metatarsal zone 22B and a heel zone 22C. The lower 20 further has a first upper end portion 22E defining a first upper opening and a first lower end portion 22D defining a sole opening. In the preferred embodiment, the first upper opening of the lower 20 extends from the metatarsal zone 22B to the heel zone 22C while the sole opening thereof extends from the toe zone 22A to the heel zone 22C.

(b) An upper 10 is formed from a relatively flexible material, such as waterproof leather and the like which is generally lighter compared to the lower 20. The upper 10 has a second lower end portion lOP of a size such that the first upper end portion 22E of the lower 20 can be smoothly seamed to the second lower end portion lOP. The upper 10 further includes two spaced eyelet tabs lOX and a tongue (not visible) which has a lower section stitched to the lower 10 and two parallel edges stitched to the eyelet tabs lOX, thereby forming a plurality of seam junctures 11.

(c) The second lower end portion lop of the upper 10 is stitched to the first upper end portion 22E of the lower 20, thereby forming a seam juncture 23.

(d) The seam juncture 23 is sealed so as to be waterproof by applying a layer of waterproof material onto the seam juncture 23 through the sole opening of the lower 20. The waterproof layer may be provided by coating the seam juncture 23 with a waterproof coating or by adhesively attaching a tape of waterproof material to the seam juncture 23 so as to cover the seam juncture 23. Note that the sole opening at the first lower end portion 22D of the lower 20 is wide enough to permit easy access to the inner surface of the seam junctures during coating of the seam junctures 11 and 23. Thereafter, an insole 30 of non-waterproof fabric is attached by a conventional method to the first lower end portion 22D of the lower 20. A seam 31 is formed between the insole 30 and the lower 20.

(e) An outsole 50 is molded from a second waterproof polymeric material, such as an abrasion resistant rubber, which is harder when compared to the first waterproof polymeric material. The outsole 50 has a shape corresponding to but is slightly larger than the cross-section of the first lower end portion 22D of the lower 20.

(f) A waterproof layer 40 of thermosetting material is provided between the adjoining surfaces of the peripheral portion 51 of the outsole 50 and the insole 30 and between the adjoining surfaces of the peripheral portion 51 and the lower end portion 22D of the lower 20. The water proof layer 40 may be provided by applying a waterproof coating or by adhesively attaching or injecting and curing a waterproof material. A waterproof seal is thus formed between the lower end portion 22D of the lower 20 and the end portion 51 of the outsole 50, so that water cannot seep into the interior of the boot.

Figure 5:
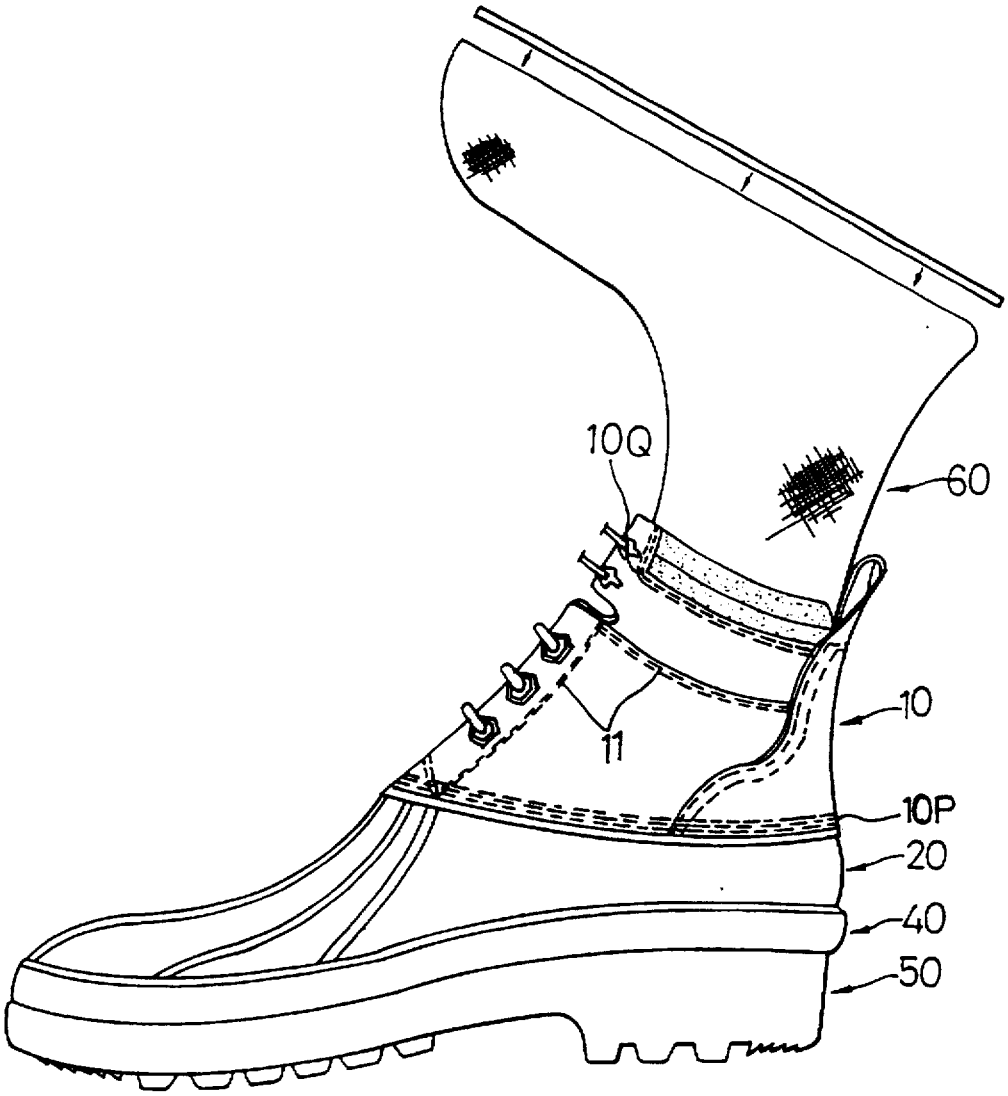
FIG. 5 illustrates how an inner liner assembly is inserted into the boot according to this invention.
Figure 6:
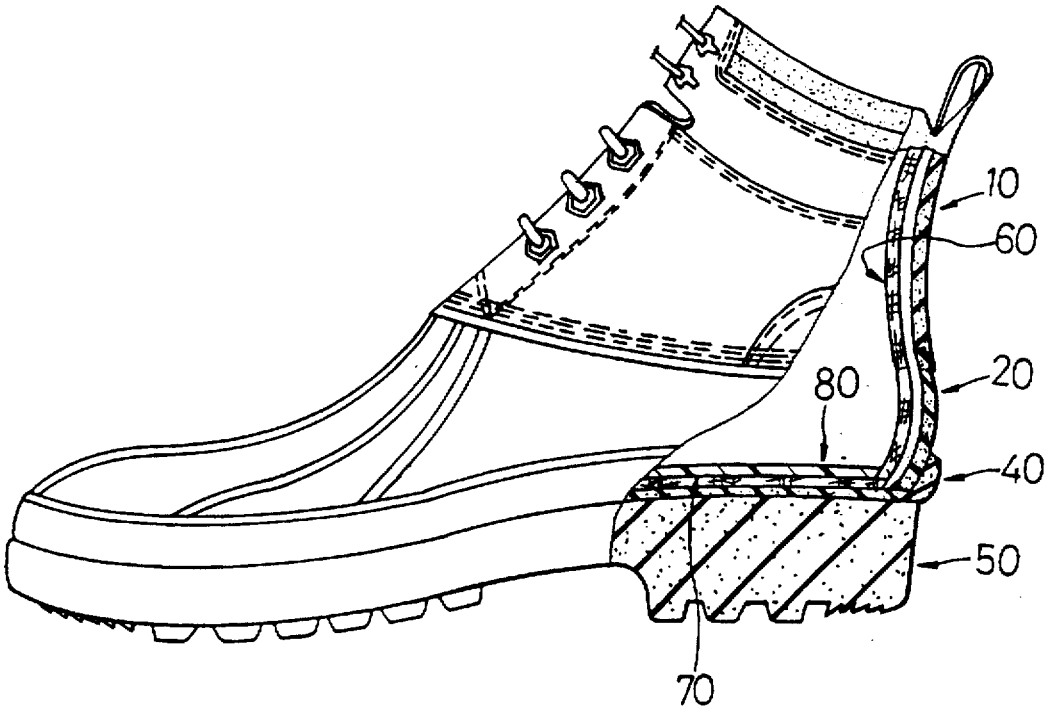
FIG. 6 is a cutaway view of the boot shown in FIG. 5.
Figure 7:
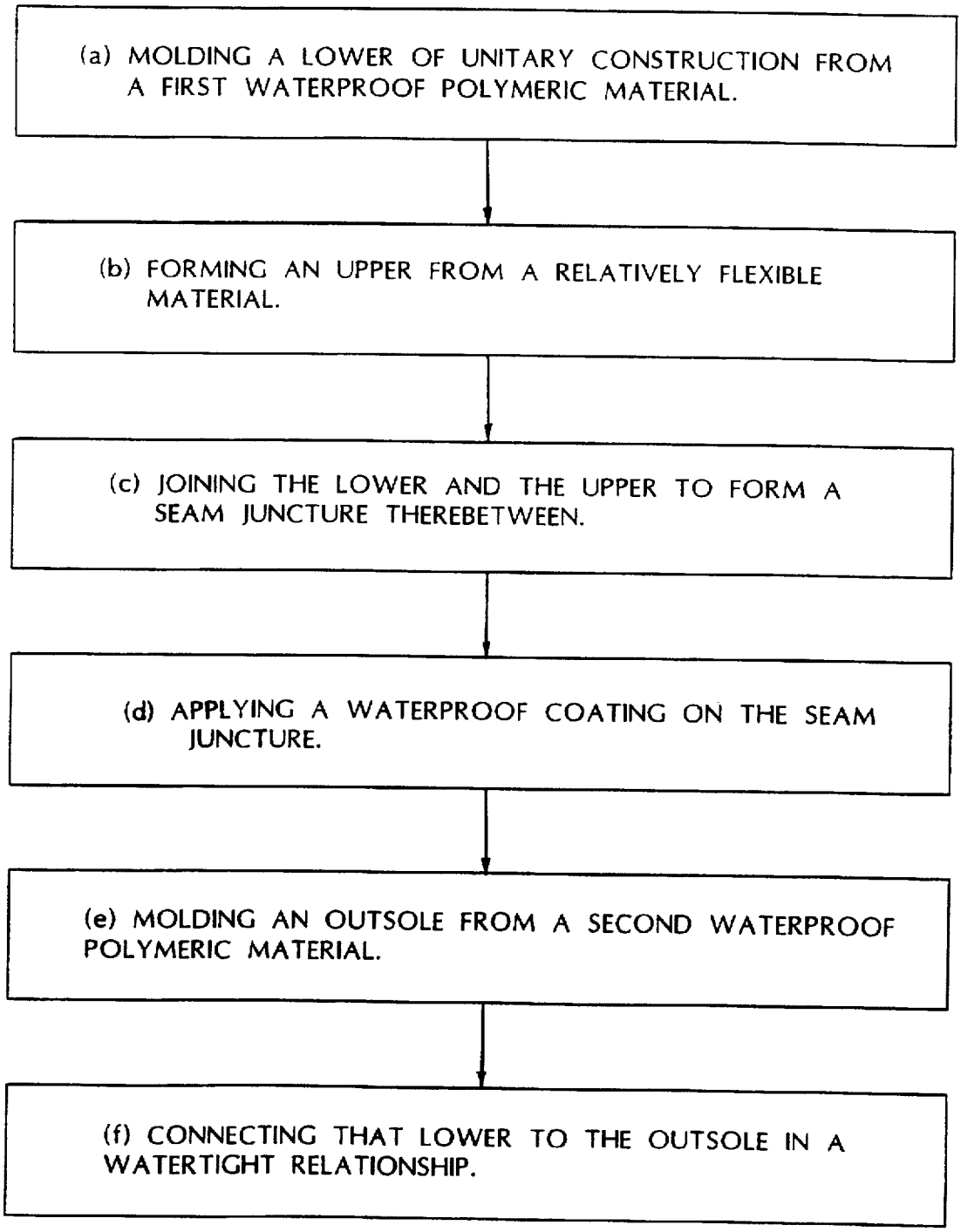
FIG. 7 is a block diagram of the method of this invention.

As illustrated in FIGS. 5 and 6, a liner 60, which has a shape conforming to that of the inner surface of the combined upper 10 and lower 20, can be stitched to a second upper end portion 10Q of the upper 10. The liner 60 is then inserted interiorly of the boot so that the liner 60 snugly fits in the boot. When desired, a foot-like padding 80 can be removably disposed at the bottom 70 of the liner 60.

Figure 8:
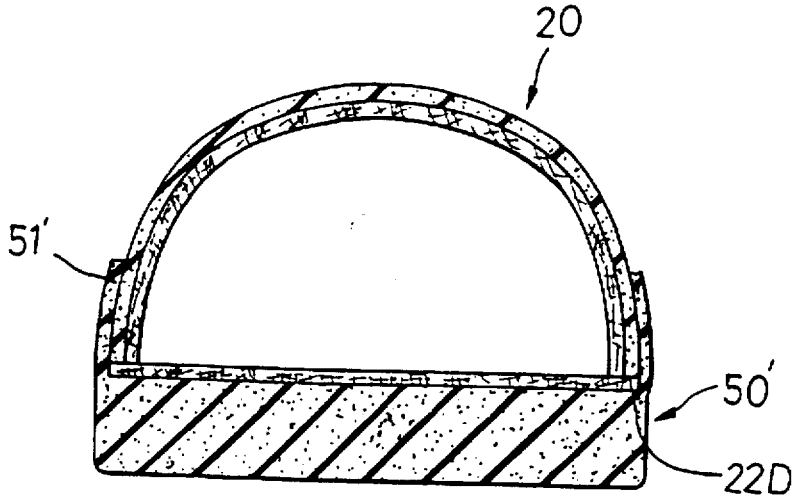
FIG. 8 is a sectional view of a modifiedembodiment according to this invention.

Referring to FIG. 8, in another preferred embodiment of this invention, an outsole 50' is formed by injection molding in the presence of the lower 20 so that the outsole 50' is formed in integral with the lower 20. The outsole 50' has a peripheral portion 51' to surround the lower end portion of the lower 20. The injection molding may be conducted in a mold (not shown) by first mounting the lower 20 on the mold and then injection molding the outsole 50' so that the peripheral portion 51' of the outsole 50' is integrally connected to the lower end portion 22D of the lower 20 in a water-tight relationship.

Figure 9:
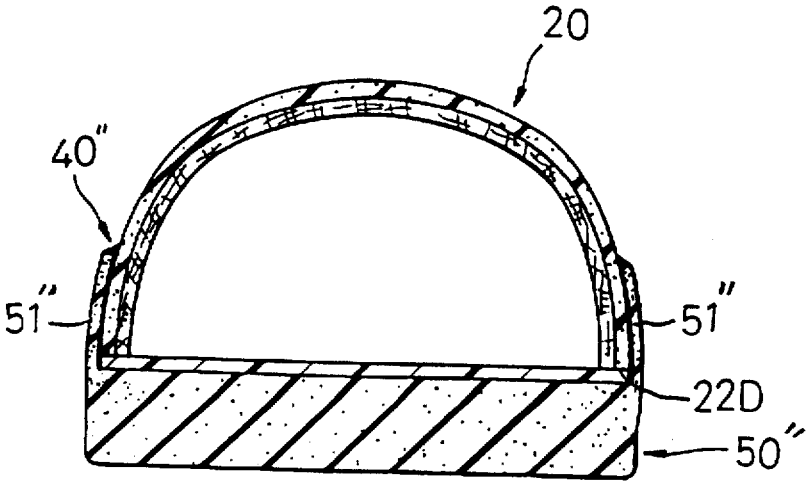
FIG. 9 is a sectional view of another modified embodiment according to this invention.

Referring to FIG. 9 illustrates a still another preferred embodiment of the present invention wherein the peripheral portion 51" of the outsole 50", which projects upwardly, is adhesively connected to the lower end portion 22D. A waterproof coating 40" is applied at the top end of the peripheral portion 51" of the outsole 50" and the adjacent surface of the lower end portion 22D of the lower 20 to provide a water-tight sealing.

With this invention thus explained, it is apparent that numerous modifications and variations can be made without departing from the scope and spirit of this invention. It is therefore intended that this invention be limited only as indicated in the appended claims.

I claim:

1. A method of forming a shoe, such as a boot, comprising the steps of:

(a) forming a lower of unitary construction from a first waterproof polymeric material, said lower defining an enclosed toe zone, and a heel zone and having a first upper end portion defining a first upper opening, and a first lower end portion defining a sole opening;

(b) forming an upper from a relatively flexible material, said upper having a second lower end portion of a size such that said first upper end portion can be smoothly seamed to said second lower end portion;

(c) joining said second lower end portion with said first upper end portion of said lower to form a seam juncture;

(d) applying a waterproof layer onto said seam juncture through said sole opening; and (e) connecting a sole to said first lower end portion of said lower in a water-tight relationship to close said sole opening after step (d).

2. A method according to claim 1, wherein said sole includes an insole and an outsole.

3. A method according to claim 2, wherein said insole is connected to said first lower end portion of said lower before said outsole is connected to said first lower end portion.

4. A method according to claim 1, wherein said step (e) is carried out by providing a waterproof layer at the adjoining surfaces of said first lower end portion of said lower and said sole.

5. A method according to claim 1, wherein said step (e) is carried out by injection molding said sole in the presence of said lower, thereby forming said sole in integral with and in a water-tight relationship with said first end portion of said lower.

6. A method according to claim 1, further comprising the steps of:

(f) stitching, at a second upper end portion of said upper, a liner having a shape conforming with that of the inner surface of the combined upper and lower; and (g) inserting said liner inside to line the interior of said combined upper and lower.

* * * * *